US007896442B2

(12) United States Patent
White

(10) Patent No.: US 7,896,442 B2
(45) Date of Patent: Mar. 1, 2011

(54) METHOD AND APPARATUS TO INGRESS AND EGRESS OF CHAIR

(76) Inventor: William L. White, Phoenix, AZ (US)

( * ) Notice: Subject to any disclaimer, the term of this patent is extended or adjusted under 35 U.S.C. 154(b) by 84 days.

(21) Appl. No.: 12/156,469

(22) Filed: May 30, 2008

(65) Prior Publication Data

US 2009/0295213 A1 Dec. 3, 2009

(51) Int. Cl.
*A47C 7/50* (2006.01)

(52) U.S. Cl. ..... 297/423.37; 297/312; 297/DIG. 10; 5/619

(58) Field of Classification Search ..... 297/312, 297/314, 423.37, DIG. 10; 5/619, 624, 648
See application file for complete search history.

(56) References Cited

U.S. PATENT DOCUMENTS

| | | | | | |
|---|---|---|---|---|---|
| 137,596 | A * | 4/1873 | Clinton et al. | ..... | 5/619 |
| 238,799 | A * | 3/1881 | Morgan | ..... | 5/619 |
| 439,088 | A * | 10/1890 | Allen | ..... | 297/423.32 |
| 2,295,006 | A * | 9/1942 | Philips | ..... | 297/423.26 |
| 3,227,439 | A * | 1/1966 | Carlson | ..... | 5/618 |
| 3,318,596 | A * | 5/1967 | Herzog | ..... | 5/619 |
| 4,225,127 | A * | 9/1980 | Strutton | ..... | 5/602 |
| 7,454,806 | B2 * | 11/2008 | Koch et al. | ..... | 5/624 |
| 2004/0133979 | A1 * | 7/2004 | Newkirk et al. | ..... | 5/600 |

* cited by examiner

*Primary Examiner*—Peter R. Brown
(74) *Attorney, Agent, or Firm*—Tod R. Nissle, P.C.

(57) ABSTRACT

A method to facilitate moving from a seated position to an upright position utilizes a chair including a seat with articulating sections and associated foot rests.

2 Claims, 3 Drawing Sheets

METHOD AND APPARATUS TO INGRESS AND EGRESS OF CHAIR

This invention pertains to chairs.

More particularly, the invention pertains to a chair that facilitates stretching inner leg muscles.

It would be desirable to provide an improved method and apparatus to stretch the inner leg muscles.

Therefore, it is a principal object of the instant invention to provide an improved system for an individual to stress inner leg muscles.

This and other, further and more specific objects and advantages of the invention will be apparent from the following detailed description thereof, taken in conjunction with the drawings, in which.

Briefly, in accordance with the invention, I provide an improved method to facilitate moving from a seated position to an upright position to travel to another piece of furniture to sit or lie, and minimize the stress on the back and legs. The method includes the step of providing a chair on a floor. The chair includes a seat at a first elevation above the floor and having a fixed rear portion, and a front portion. The front portion includes a first section, and a second section adjacent to and laterally separable from the first section. A first foot rest is attached to and spaced downwardly from the first section and forwardly from the rear portion. A second foot rest is attached to and spaced downwardly from the second section and forwardly from the rear portion. The method of the invention also includes the steps of sitting in the chair with one foot on the first foot rest, the other foot on the second foot rest, and each knee pronated; sitting on the fixed rear portion of the seat; separating one leg from the other and stretching inner leg muscles by separating laterally the first section from the second section, and separating the first foot rest from the second foot rest; increasing the pronation of at least one knee, stretching at least one thigh muscle, and aligning the one foot beneath the buttocks by moving the one foot from the first foot rest to the floor, and along the floor rearwardly toward the rear portion of the seat; reducing the pronation of the knees by rising from the chair to a standing position; and, moving to the other piece of furniture. The seat can, prior to leaving the chair, be raised to a second elevation above the floor greater than the first elevation.

Figure 1:
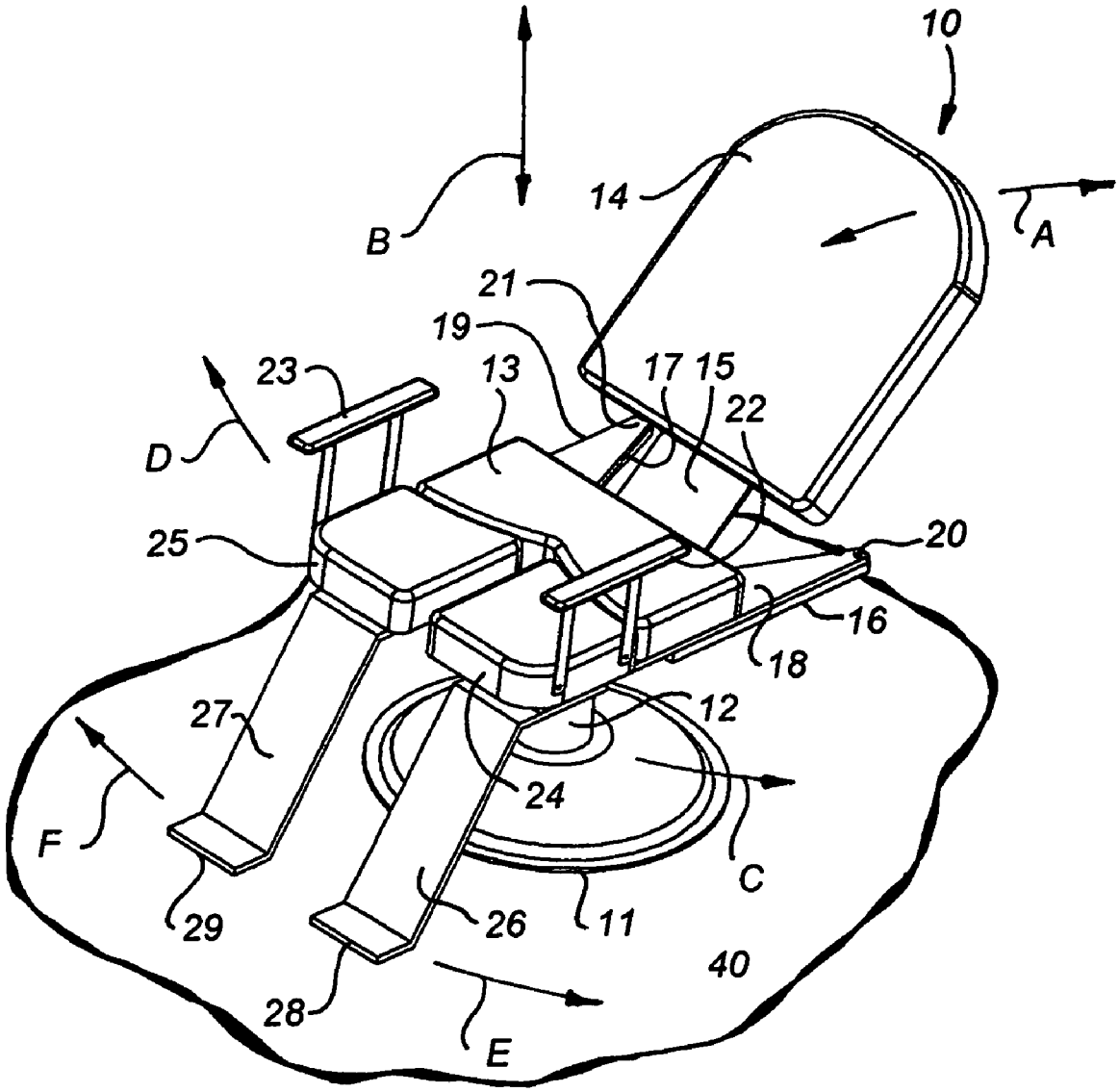
FIG. 1 is a perspective view illustrating a chair constructed in accordance with the invention.

Turning now to the drawings, which depict the presently preferred embodiments of the invention for the purpose of illustrating the practice thereof and not byway of limitation of the scope of the invention, and in which like reference characters refer to corresponding elements throughout the several views, FIG. 1 illustrates a chair constructed in accordance with the invention and generally indicated by reference character 10.

Chair 10 includes a base 11 on floor 40. Leg 12 upwardly depends from base 11. Chair 10 can, if desired, include two or more legs. Leg 12 can, if desired, have a pneumatic configuration like that of a barber chair so that leg 12 can be operated to raise and lower in the directions indicated by arrow B the seat portions 12, 24, 25 and other components mounted on the upper end of leg 12.

Lower triangular wings 16 and 17 are fixedly secured to the upper end (not visible) of leg 12. Upper triangular wing 18 is pivotally slidably attached to lower wing 16 by pin 20. Upper triangular wing 19 is pivotally slidably attached to lower win 17 by pin 21. The shape and dimension of wing 16 is equivalent to that of wing 17. The shape and dimension of wing 18 is equivalent to that of wing 19.

The seat of chair 10 includes portions 13, 24, 25 Rear portion 13 is fixedly secured to the upper end (not visible) of leg 12. Front portion 24 is fixedly secured to upper wing 18. Front portion 25 is fixedly secured to upper wing 19.

Leg rest 26 is fixedly secured to upper wing 18. Foot rest 28 is attached to leg rest 26. Leg rest 27 is fixedly secured to upper wing 19. Foot rest 29 is attached to leg rest 27. Arm rest 22 is attached to front seat portion 24. Arm rest 23 is attached to front seat portion 25. The arm rests 22 and 23, leg rests 26 and 27, and foot rests 28 and 29 can be mounted on any desired structural member(s) of chair 10.

Member 15 secures back rest 14 to the upper end (not visible) of leg 12. Chair 10 can be constructed with any of a variety of known mechanical systems which permit the angle of tilt of back rest 14 to be adjusted in the directions indicated by arrows A. Similarly, chair 10 can be constructed with any desired mechanical system that permits front portions 24 and 25 to be separated in the directions indicated by arrows C and D in FIG. 1, and, to be moved back together to the configuration illustrated in FIG. 1. Such a mechanical system may, or may not, include motors operable to displaced front portions 24 and 25 in the directions indicated by arrows C and D. In the chair 10 illustrated in FIG. 1, front portion 24 is displaceable in the direction of arrow C from the closed position shown in FIG. 1 by simply grasping and manually pulling front portion 24 in the direction of arrow C such that upper wing 18 pivots about pin 20 and slides over lower wing 16 in the direction of arrow C to the open position illustrated in FIG. 2. Likewise, front portion 25 is displaceable in the direction of arrow D from the closed position shown in FIG. 1 by simply grasping and manually pulling front portion 25 in the direction of arrow D such that upper wing 19 pivots about pin 21 and slides over lower wing 17 to the open position illustrated in FIG. 2.

Figure 2:
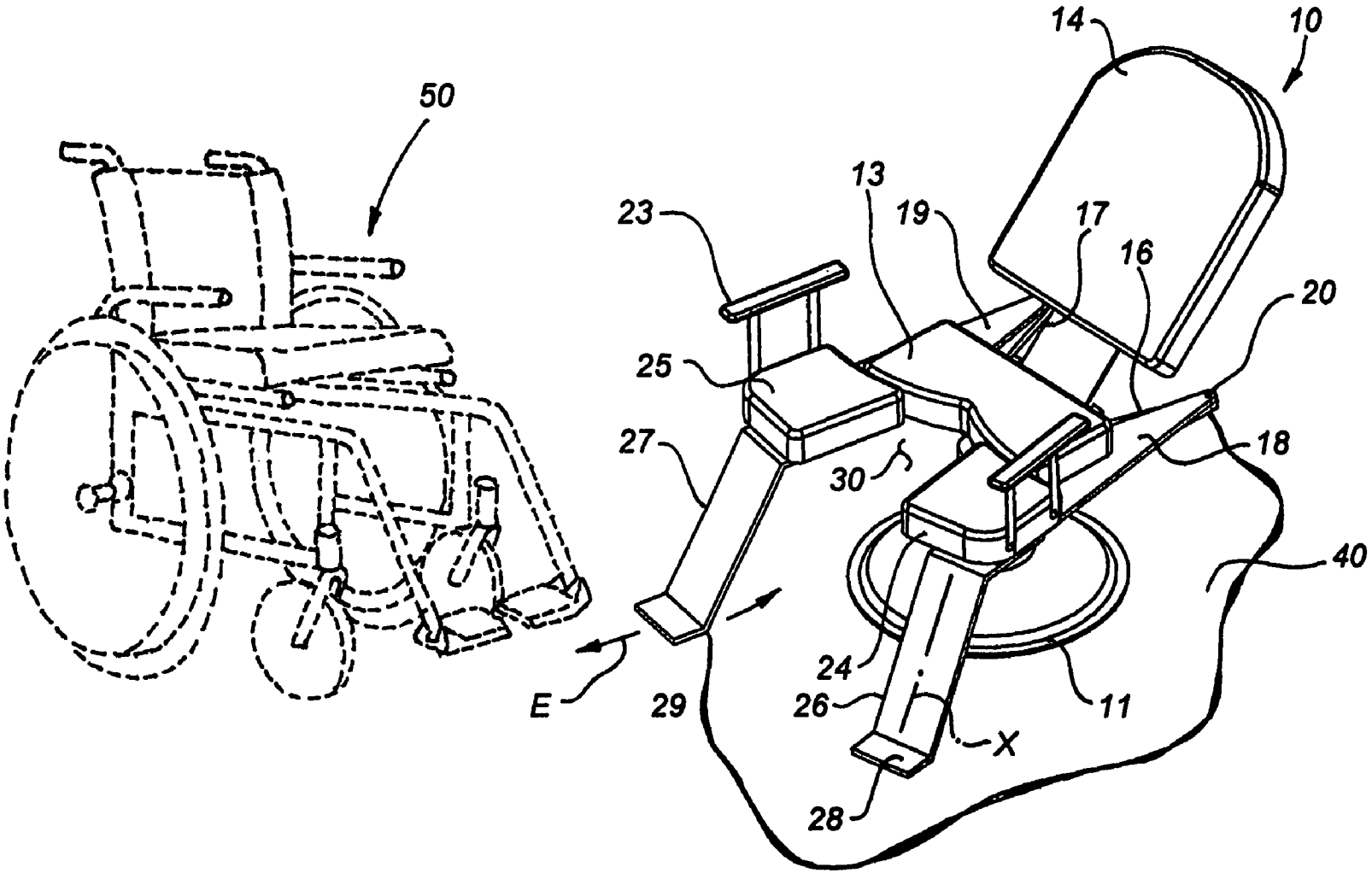
FIG. 2 is a perspective view of the chair of FIG. 1 illustrating the mode of operation thereof.

Front portion 25 is displaceable in a direction opposite that of arrow D from the open position shown in FIG. 2 by simply grasping and manually pushing front portion 25 in the direction opposite that of arrow D such that upper wing 19 pivots about pin 21 and slides over lower wing 17 to the closed position illustrated in FIG. 2. Likewise, front portion 24 is displaceable in a direction opposite that of arrow C from the open position shown in FIG. 2 by simply grasping and manually pushing front portion 24 in the direction opposite that of arrow C such that upper wing 18 pivots about pin 20 and slides over lower wing 17 to the closed position illustrated in FIG. 2.

When front portions 24 and 25 are moved between the closed position of FIG. 1 and the open position of FIG. 2, foot rest 28, leg rest 26 and arm rest 22 move simultaneously with front portion 24. In a similar manner, foot rest 29, leg rest 27, and arm rest 23 move simultaneously with front portion 25.

Chair 10 can be constructed such that each leg rest 26 and/or foot rest 28 can be indexed and moved to a plurality of different positions by rotating each leg rest 26 and/or foot rest 28 about a vertically oriented axis X (FIG. 2).

Chair 10 can also be constructed such that each leg rest 27 and/or foot rest 29 can be indexed and moved to a plurality of different positions by moving each leg rest 27 and/or foot rest 29 in the directions indicated by arrows E toward or away from base 11 (FIG. 2).

In FIGS. 1 and 2, front portions 24 and 25 are generally parallel to floor 40. Chain 10 can be constructed such that each portion 24, 25, 12 of the seat is or can be adjustably tilted with respect to floor 40.

The chair 10 was originally constructed to provide a means for an individual, while sitting, to separate his or her legs to stretch gently the muscles in the inner areas of the legs. Such muscles can, if injured, take a significant amount of time to heal.

One particular benefit discovered after the chair of the invention was constructed is that when the chair is used to stretch the inner muscles of the legs, it enables an individual in the chair to relax inner leg muscles because the body of the individual is supported by the chair. The leg muscles are not engaged to support the body.

Another benefit discovered after the chair of the invention was constructed is that when the front portions 24 and 25 are moved from the closed position of FIG. 1 to the open position of FIG. 2, the front portions 24 and 25, footrests 28 and 29, and leg rests 26 and 27 "carry" and laterally displace the feet and legs of an individual sitting in the chair. Consequently, the individual need not exert any energy to separate his or her legs, which enables the individual to concentrate on relaxing so the muscles are able to better stretch.

Still another benefit discovered after the chair of the invention was constructed is that each seat portion 24 and 25 can be incrementally moved from the closed position of FIG. 1 to the open position of FIG. 2, which permits the amount of stretch to be adjusted per individual taste and which permits the distance between front portions 24 and 25 to be gradually increased to increase the amount of stretch as the leg muscles relax in the stretch.

After the chair 10 was developed as a means to stretch the inner muscles of the legs, I discovered a first unexpected and unpredicted benefit of the chair 10. The chair 10 is, when utilized in accordance with one embodiment of the invention, believed to be particularly useful in enabling an individual to sit in and arise from the chair, especially when the individual is older or is convalescing. In attempting "after the fact" to theorize why this is the case, the following analysis has been developed.

When an individual sits in a chair, movement of the individuals legs and body is restricted, and blood tends to pool in the lower extremities of the individual. After time passes, the individual's leg muscles and joints tend to stiffen. While such stiffening may not be the case with young children and young adults, it is more of an issue with advancing age and with patent attorneys, Patent Office Examiners, and other individuals that spend long periods of office time seated or are recuperating from an injury or illness.

Attempting to arise from a chair can, for some individuals, be a rather slow, painful, and awkward experience.

Further, if attempting to arise from a chair is difficult, an individual is, when attempting to leave the chair, more likely to bend far forward to produce momentum to stand up and, accordingly, to put his back at risk and to injure his back.

Figure 3:
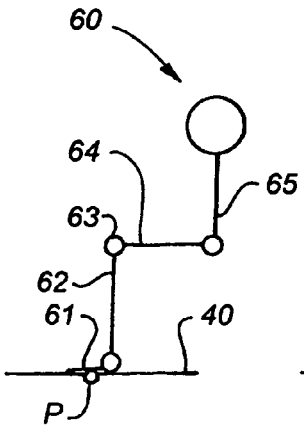
FIG. 3 is a side elevation view illustrating an individual's orientation when sitting in a conventional chair.
Figure 4:
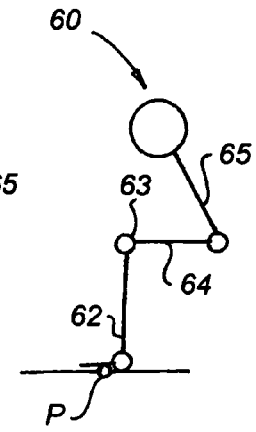
FIG. 4 is a side elevation view illustrating an individual leaning forward to begin arising from a conventional chair.
Figure 5:
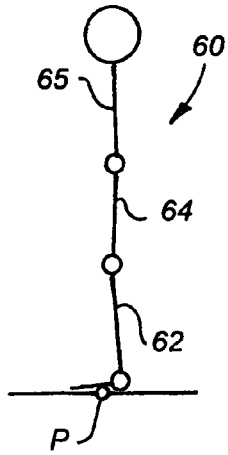
FIG. 5 is a side elevation view illustrating an individual standing after the individual has arisen from a convention chair.

FIGS. 3 to 5 illustrate a conventional procedure for arising from a chair. In FIG. 3 an individual 60 is seated in a chair (not shown). The individual 60 has an upper body, upper leg (thigh) 64, lower leg (calf 62, and foot 61. In order to arise from the chair, the individual tilts forward in the manner illustrated in FIG. 4 to gain some momentum, and then uses his legs to move to the standing position of FIG. 5. While literally millions of individuals perform this maneuver daily, age or illness render the maneuver more difficult, particularly because of the strength required by the thighs and "core" and because of the stress the maneuver can place on the lower back if the individual tends to arch his back (instead of maintaining a flat back) when tilting forward in the manner illustrated in FIG. 4. One factor that aggravates this situation is that the individual's feet remain in front of his upper body in a position over point P indicated in FIGS. 3 to 5.

Figure 6:
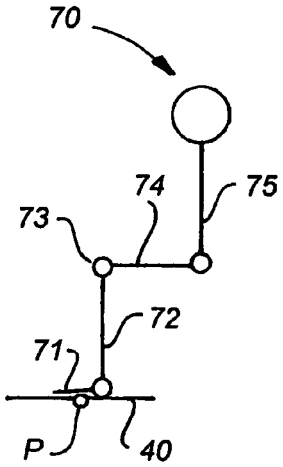
FIG. 6 is side elevation view illustrating an individual's orientation when sitting in a chair constructed in accordance with one embodiment of the invention.
Figure 7:
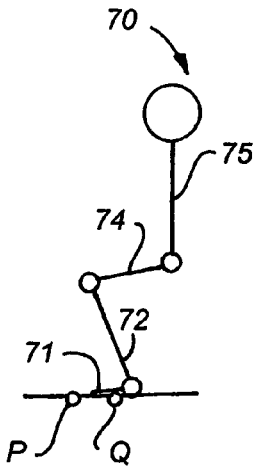
FIG. 7 is a side elevation view illustrating an individual beginning to arise from a chair in accordance with a method in one embodiment of the invention.
Figure 8:
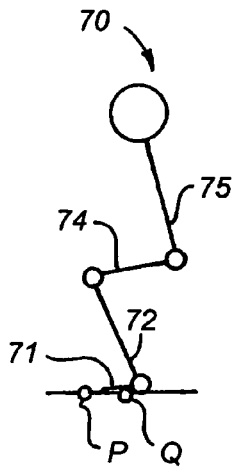
FIG. 8 is a side elevation view illustrating an individual beginning to arise from a chair in accordance with the method of the invention of FIG. 7; and, FIG. 9 is a side elevation view illustrating an individual arisen from the chair in accordance with the method of the invention of FIG. 7.
Figure 9:
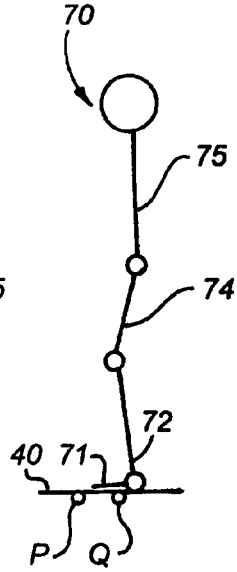

In one embodiment of the invention, an individual in chair 10 arises in the following manner. This procedure is illustrated in FIGS. 6 to 9 with respect to an individual generally indicated by reference character 70 and including foot 71, calf 72, thigh 74, and upper body 75. First, the individual 70 sits on the rear portion 13 of the seat of chair 10 (not shown). Second, front sections 24 and 25 are moved from the closed position of FIG. 1 to the open position of FIG. 2. This functions to stretch and activate inner leg muscles. Third, the individual moves one or both of his or her feet 71 laterally inwardly off foot rests 28 and 29 toward one another to a position generally over a point P, as illustrated in FIG. 6. Fourth, the individual continues to move his foot rearwardly in a direction toward base 11 and rear portion 13 to a position over point Q. The position of foot 71 over point Q is illustrated in FIG. 7. In FIG. 7, foot 71 is generally beneath and aligned with the hips and upper body of individual 70, which produces the result of requiring less energy to arise from chair 10. The other result of moving foot 71 from a position over point P to a position over point Q is that it further pronates the knee and stretches the quadriceps. This is particularly advantageous because leg muscles tend to stiffen when sitting in a chair. Stretching leg muscles before standing helps overcome stiffness and place the legs in better condition to function. Fifth, the individual his or her upper body 75 forward in the manner illustrated in FIG. 8. The upper body tilt in FIG. 8 is significantly less than the upper body tilt in FIG. 4 because of the position of foot 71 over point Q. Sixth, the individual uses his legs to stand in the orientation illustrated in FIG. 9 with his foot 71 over point Q.

While the foregoing theoretical analysis evolved after the invention was developed, the analysis is believed to comprise a reasonably plausible explanation and is, at least in part, readily tested by standing up from a chair in the conventional manner illustrated in FIGS. 3 to 5, and by then standing up from a chair with a seat that permits the movements illustrated in FIGS. 6 to 9.

The "pre-standing" stretching of the leg muscles and positioning of foot 71 over point Q result in significantly less effort being required in the method of FIGS. 6 to 9, which is believed to be of critical importance when moving a convalescing individual from a bed to the chair 10, or moving the convalescing individual out of chair 10 to a bed or other desired location.

When an individual is sitting in the chair and wishes to stand, raising the chair 10 and the elevation of the seat can be beneficial because when the individual steps off foot rests 28 and 29, the foot rests 28 and 29 are above the floor 40. Increasing the height above floor 40 of the footrests 28 and 29 before an individual leaves the chair 10 can, when the individual steps off footrests 28 and 29, function to partially straighten the leg and reduce the distance that the individual must upwardly move his upper body to reach the standing position of FIG. 9.

Similarly, raising the seat of chair 10 can facilitate an individual's initially sitting in chair 10 by reducing the distance that an individual has to lower his upper body such that his buttocks contact the rear portion 13 of the chair 10. After the individual sits on rear potion 13 (with portions 14 and 25 in the open position of FIG. 2), the individual places his feet on foot rests 28 and 29 and front portions are moved from the open position of FIG. 2 to the closed position of FIG. 1.

After the chair 10 was constructed, I discovered a second unanticipated benefit of the chair. The ability of the front portions of the chair to separate permits, in accordance with another embodiment of the invention, ready access to the perineal area of an individual sitting in the chair which facilitates cleaning or otherwise treating the perineal area. In comparison, attempting to clean or otherwise treat the perineal area while an individual is in bed can require that two or more individuals be present to turn the individual over and access the perineal area.

When the chair was developed, I was not aware of any market trend emphasizing that there was a problem stretching the inner muscles of the legs or that the market was searching for another way to stretch the inner muscles of the leg, to facilitate arising from a chair, or to facilitate cleaning or treating the perineal area. There appears to be no market need or trend directing a particular solution in such respects, much less somehow suggesting a chair structure. Even if a chair structure were suggested, there evidently existed at the time of the invention no motivation to divide the seat of a chair into sections, to make some of the sections movable, and some not, and to utilize such a chair in a manner that facilitates stretching, facilitates ingress into and egress from the chair, and facilitates cleaning or otherwise treating the perineal area.

Unless there is good reason to the contrary, judicial notice is taken of the following facts:

1. There existed at the time of the invention a dominant, long felt trend that chairs include a single unitary seat. Millions of chairs have for many years been constructed and sold with a seat the is intended to be used in a single configuration.
2. A countervailing subservient trend with respect to said dominant trend in 1. above did not appear to exist at the time of the invention, and if it did exist was obfuscated by the trend in 1. above or by other trends.
3. There existed at the time of the invention a dominant, long felt trend that a chair seat would remain in a unitary configuration while an individual is seated in or rising from the chair. People have played out this scenario over and over.
4. A countervailing subservient trend with respect to said dominant trend in 4. above did not appear to exist at the time of the invention, and if it did exist was obfuscated by the dominant trend in 3. above or by other trends.
5. There existed at the time of the invention a dominant, long felt trend to clean or otherwise treat the perineal area of an individual while the individual reclined. This common procedure has been carried out for many years.
6. A countervailing subservient trend with respect to said dominant trend if 5. above did not did not appear to exist at the time of the invention, and if it did exist was obfuscated by the dominant trend in 5. above or by other trends.
7. There did not exist at the time of the invention a recognized problem, market need, or motivation that provided significant impetus to develop the invention.
8. There did not exist at the time of the invention a recognized problem to which there was a set of specific solutions, one of which was the invention.
9. Common sense is judgment that requires valid reasoning supporting and justifying such judgment.

A. The People In Common (PIC) Definition: "The Earth is Flat".

One definition of common sense is what people in common would agree upon, that which they "sense" as their common natural understanding or would consider in most people's experience to be prudent and of sound judgment. This definition assumes a country with a population with a particular baseline language, customs and knowledge. The baseline knowledge is knowledge available and known by a large majority of the population, and is knowledge that typically does not require specialized knowledge or study; such baseline knowledge can change over time depending on the success of educational institutions, changing societal climes, etc. Under the people in common (PIC) definition, common sense often has been wrong and, for example, at one time held that the earth was flat. Even today it evidently is estimated that 60% of the people on earth believe the sun revolves around the earth. Others today use common sense to make the judgment that heavier bodies fall faster than light bodies.

B. The Common Man Sound Judgment (CMSJ) Definition.

A second definition of common sense is sound judgment based on a simple perception of the situation or facts. Sound judgment means sensible judgment based on valid reasoning. This suggests that a common sense judgment, if reliable, is subject to evaluation to see if there are reasons or criteria that support and justify the judgment. This definition assumes a country with a population with a particular baseline language, customs and knowledge. The baseline knowledge is knowledge available and known by a large majority of the population, and is knowledge that typically does not require specialized knowledge or study; such baseline knowledge can change over time depending on the success of educational institutions, changing societal climes, etc. What might be common sense to an American might not be common sense to a person living in another country. An individual could move to the United States from India and what might appear common sense to an American would, because of the culture of India, make absolutely no sense to the Indian. In evaluating obviousness, however, it is usually, for better or worse, assumed that the Indian has the same baseline knowledge as individuals who have grown up in the United States.

C. The Ordinary Skill Sound Judgment (OSSJ) Definition.

A third definition of common sense is sound judgment by one of ordinary skill in the art based on a perception of the situation or facts in the context of the baseline knowledge in CMSJ and of specialized knowledge that is over and above said baseline knowledge and is attributed to one of ordinary skill in the art. As noted, sound judgment means sensible judgment based on valid reasoning. This suggests that a common sense judgment by one or ordinary skill in the art is, if reliable, subject to evaluation to see if there are reasons or criteria that support and justify the judgment. This definition assumes a country with a population with a particular baseline language, customs and knowledge. The baseline knowledge and specialized knowledge comprise knowledge available and known by a large majority of those of skill in the art; such baseline knowledge and specialized knowledge can change over time depending on the success of educational institutions, advances in the art, changing societal climes, etc. What might be common sense to an American of ordinary skill in the art might not be common sense to a person that lives in another country and appears to be one of ordinary skill in the art. In evaluating obviousness, however, it is usually, for better or worse, assumed that the person of ordinary skill in the art from India has the same baseline knowledge as individuals of skill in the art who have grown up in the United States. In some technically simple inventions, the ordinary skill sound judgment (OSSJ) may be commensurate with common man sound judgment (CMSJ) because there is little if any specialized knowledge required. For example, a new Christmas tree ornament design might not require any particular specialized knowledge over and above the baseline knowledge of the large majority of people. In contrast, many inventions obviously require a specialized knowledge over and above commonly held baseline knowledge, in which case such specialized knowledge will be utilized in the sound reasoning involved in ordinary skill sound judgment common sense.

As used herein, relying on common sense judgment requires that valid reasoning justifying such judgment be set forth.

10. One of ordinary skill in the art with respect to the invention herein has specialized knowledge over and above the baseline knowledge of the general population, which specialized knowledge is in connection with physiology and treatment methodology of the perineal area. Evaluating the obviousness of the invention requires specialized knowledge over and above the baseline knowledge of the population; namely, knowledge in connection with evaluating the effects on the body of stretching and positioning of the body while sitting in or arising from a chair, and in connection with the treatment of the perineal area in healthy and convalescing individuals.
11. The TSM test can, per KSR, provide helpful insight into whether an invention is obvious.
12. There is no reason not to utilize the TSM test to assist in evaluating the obviousness of the invention.
13. The broad general motivation to make a product or process better is common to each invention.
14. There normally are broad commonplace motivations with respect to each particular class of invention. For example, one commonplace motivation with respect to exercise equipment is to make it versatile.
15. The existence of a broad general motivation, without more, does not necessarily provide any significant impetus to produce an invention. This is evidenced by that fact that broad general motivations have existed for years before inventions were discovered.
16. A specific problem, motivation, or market trend is more likely to produce significant impetus to produce an invention than a commonplace motivation. If, for example, a piece of exercise equipment causes a greater than normal quantity of injuries, that is more likely to produce significant impetus to produce an invention that the commonplace motivation of making equipment better.
17. A problem may not provide significant impetus for an invention if the problem suggests solutions other than the invention.

Pronation. As used herein, pronation refers to bending of the knee and occurs when the bottom part of the leg (calf and foot) pivots about the knee so that (1) the foot moves rearwardly and upwardly toward the back of the thigh, and (2) the bottom part (calf) and upper part (thigh) of the leg are not in alignment. Pivoting the foot and bottom part of the leg about the knee until the foot touches or is near the buttocks results produces a severely pronated knee that is bent back on itself.

Having described my invention in such terms as to enable those of skill in the art to understand and use it, and having described the presently preferred embodiments and best mode thereof, I claim:

1. A method to facilitate moving from a seated position to an upright position to travel to another piece of furniture to sit or lie, and to minimize the stress on the back and legs, comprising the steps of (a) providing a chair on a floor, said chair including a seat at a first elevation above the floor and having
- (i) a ground engaging support leg (12) having an upper end,
- (ii) a fixed rear seat portion (13) connected to said upper end,
- (iii) a first fixed wing (16) connected to said upper end and extending beneath and rearwardly said from said fixed rear seat portion;
- (iv) a second wing (18) extending forwardly from, beneath, and rearwardly from said fixed rear seat portion,
- (v) a third fixed wing (17) connected to said upper end and extending beneath and rearwardly from said fixed rear seat portion,
- (vi) a fourth wing (19) extending forwardly from, beneath, and rearwardly from said fixed rear seat portion,
- (vii) a first pivot (20) pivotally interconnecting said first and second wings at a point rearwardly from said fixed rear seat portion,
- (viii) a second pivot (21) pivotally interconnecting said third and fourth wings at a point rearwardly of said fixed rear seat portion,
- (ix) a first front seat portion including
  - a first section (24)
    - extending forwardly from said fixed rear seat portion, and fixedly mounted on said second wing,
  - a first foot rest (28) fixedly attached to and extending downwardly from said second wing and forwardly from said fixed rear seat portion,
  - a first arm rest (22) attached to said first section,
- (x) a second front seat portion including
  - a second section (25)
    - laterally separable from said first section,
    - extending forwardly from said fixed rear seat portion, and
    - fixedly mounted on said fourth wing,
  - a second foot rest (29) fixedly attached to and extending downwardly from said fourth wing and forwardly from said fixed rear seat portion, and
  - a second arm rest (23) attached to said second section, said first section, said first foot rest, and said first arm rest pivotable simultaneously with said second wing about said first pivot between at least two operative positions,
- a first operative position with said first section adjacent said second section, and
- a second operative position with said first section moved laterally in a direction (C) away from said second section, said second section, said second foot rest, and said second arm rest pivotable simultaneously with said fourth wing about said second pivot between at least two operative positions, a primary operative position with said first section adjacent said second section, and a secondary operative position with said first section moved laterally in a direction (D) away from said second section;

(b) sitting in said chair with (i) one foot on said first foot rest, (ii) the other foot on said second foot rest, and (iii) each knee pronated;

(c) sitting on said fixed rear portion of said seat;

(d) separating one leg from the other by (i) moving said first section from said first to said second operative position, and (ii) moving said second section from said primary to said secondary operative position;

(e) increasing the pronation of at least one knee, stretching at least one thigh muscle, and aligning said one foot beneath the buttocks by, while sitting on said fixed rear seat portion moving said one foot from said first foot rest (i) to the floor, and (ii) along the floor rearwardly toward said rear portion of said seat to a position with the heel and toe of said one foot on the floor;

(f) reducing the pronation of the knees by rising from said chair to a standing position; and, (g) moving to said other piece of furniture.

2. The method of claim 1 wherein (a) wherein in step (a), said chair includes a mechanism to increase and decrease the elevation of the seat;

(b) including the step intermediate steps (b) and (c) of raising said seat to a second elevation above the floor greater than said first elevation.

* * * * *